US005492241A

United States Patent [19]

Barnett et al.

[11] Patent Number: 5,492,241

[45] Date of Patent: Feb. 20, 1996

[54] VENTED REFUSE CONTAINER

[76] Inventors: Russell R. Barnett; Angie A. Barnett, both of 1231 Hwy. 30 East, Etowah, Tenn. 37331

[21] Appl. No.: 361,741

[22] Filed: Dec. 22, 1994

[51] Int. Cl.[6] ..... B65D 25/14

[52] U.S. Cl. ..... 220/404; 220/908

[58] Field of Search ..... 220/404, 908

[56] References Cited

U.S. PATENT DOCUMENTS 4,294,379 10/1981 Bard ..... 220/908 X 5,375,732 12/1994 Bowers et al. ..... 220/404

5,388,717 2/1995 LeVasseur ..... 220/404

*Primary Examiner*—Steven M. Pollard

[57] ABSTRACT

A refuse container for permitting ease of removal of a loaded trash bag therefrom. The inventive device includes a container for receiving a trash bag to be filled. A vent assembly extends along a sidewall of the container to vent air beneath the trash bag to preclude vacuum coupling between a full trash bag and the container.

2 Claims, 4 Drawing Sheets

VENTED REFUSE CONTAINER

BACKGROUND OF THE INVENTION

1. Field of the Invention

The present invention relates to container structures and more particularly pertains to a vented refuse container for permitting ease of removal of a loaded trash bag therefrom.

2. Description of the Prior Art

The use of container structures is known in the prior art. More specifically, container structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art container structures include U.S. Pat. Nos. 5,265,755; 5,065,891; 5,031,796; 4,715,572; and 4,349,123.

While these devices fulfill their respective, particular objectives and requirements, the aforementioned patents do not disclose a vented refuse container for a vented refuse container for permitting ease of removal of a loaded trash bag therefrom which includes a container for receiving a trash bag to be filled, and a vent assembly extending along a side wall of the container to vent air beneath the trash bag to preclude vacuum coupling between a full trash bag and the container.

In these respects, the vented refuse container according to the present invention substantially departs from the conventional concepts and designs of the prior art, and in so doing provides an apparatus primarily developed for the purpose of permitting ease of removal of a loaded trash bag therefrom.

SUMMARY OF THE INVENTION

In view of the foregoing disadvantages inherent in the known types of container structures now present in the prior art, the present invention provides a new vented refuse container construction wherein the same can be utilized for permitting ease of removal of a loaded trash bag therefrom. As such, the general purpose of the present invention, which will be described subsequently in greater detail, is to provide a new vented refuse container apparatus and method which has many of the advantages of the container structures mentioned heretofore and many novel features that result in a vented refuse container which is not anticipated, rendered obvious, suggested, or even implied by any of the prior art container structures, either alone or in any combination thereof.

To attain this, the present invention generally comprises a refuse container for permitting ease of removal of a loaded trash bag therefrom. The inventive device includes a container for receiving a trash bag to be filled. A vent assembly extends along a sidewall of the container to vent air beneath the trash bag to preclude vacuum coupling between a full trash bag and the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vented refuse container apparatus and method which has many of the advantages of the container structures mentioned heretofore and many novel features that result in a vented refuse container which is not anticipated, rendered obvious, suggested, or even implied by any of the prior art container structures, either alone or in any combination thereof.

It is another object of the present invention to provide a new vented refuse container which may be easily and efficiently manufactured and marketed.

It is a further object of the present invention to provide a new vented refuse container which is of a durable and reliable construction.

An even further object of the present invention is to provide a new vented refuse container which is susceptible of a low cost of manufacture with regard to both materials and labor, and which accordingly is then susceptible of low prices of sale to the consuming public, thereby making such vented refuse containers economically available to the buying public.

Still yet another object of the present invention is to provide a new vented refuse container which provides in the apparatuses and methods of the prior art some of the advantages thereof, while simultaneously overcoming some of the disadvantages normally associated therewith.

Still another object of the present invention is to provide a new vented refuse container for permitting ease of removal of a loaded trash bag therefrom.

Yet another object of the present invention is to provide a new vented refuse container which includes a container for receiving a trash bag to be filled, and a vent assembly extending along a side wall of the container to vent air beneath the trash bag to preclude vacuum coupling between a full trash bag and the container.

Even still another object of the present invention is to provide a new vented refuse container which includes a vent means attachable to a corner of an existing container to provide venting beneath a trash bag positioned therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
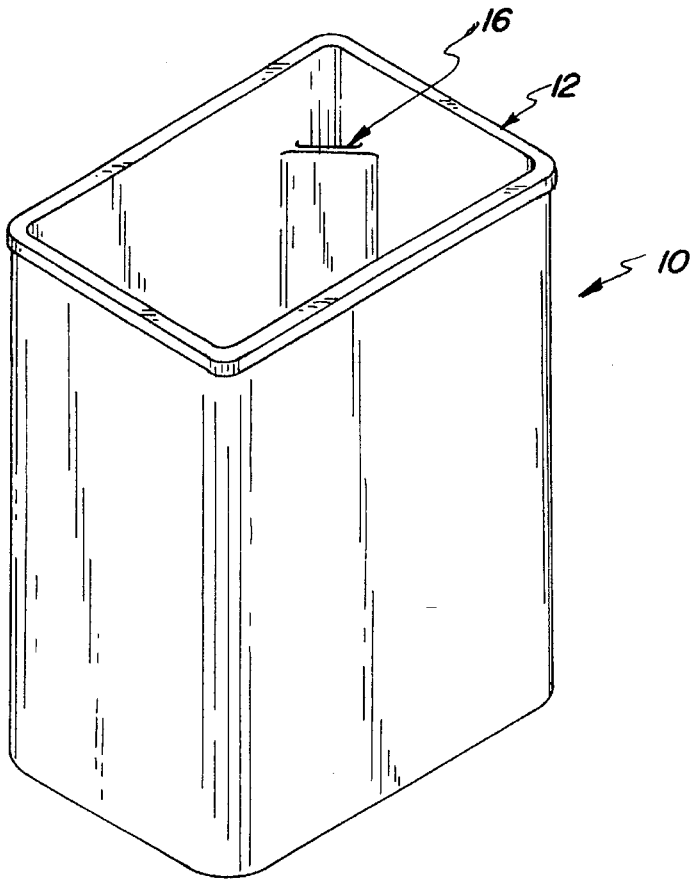
FIG. 1 an isometric illustration of a vented refuse container according to the present invention.

With reference now to the drawings, and in particular to FIGS. 1–8 thereof, a new vented refuse container embodying the principles and concepts of the present invention and generally designated by the reference numeral 10 will be described.

Figure 4:
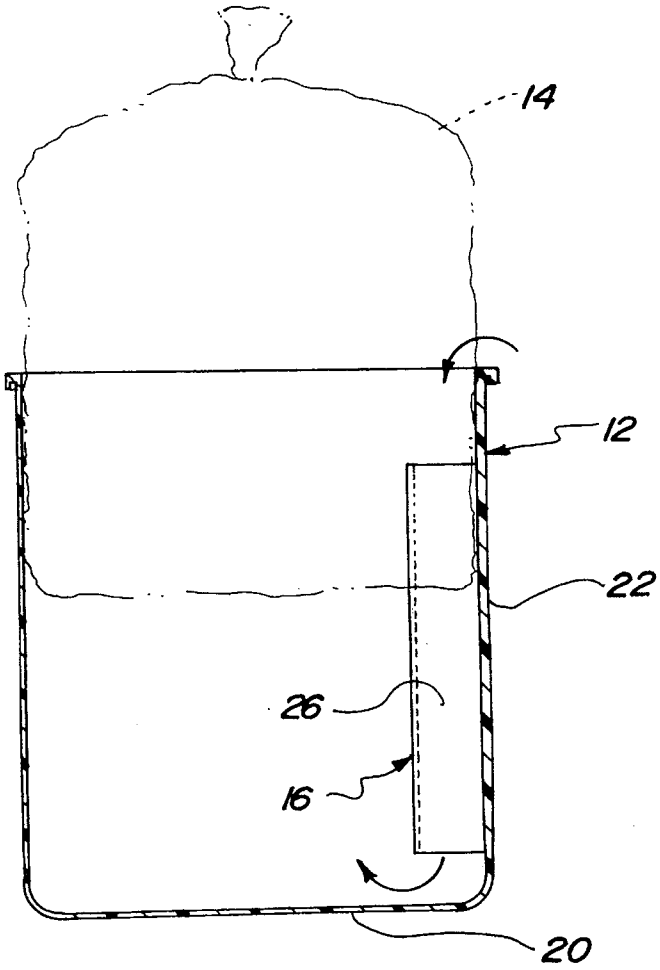
FIG. 4 is a further cross-sectional view of the invention detailing a flow of air beneath the trash bag positioned therein.
Figure 3:
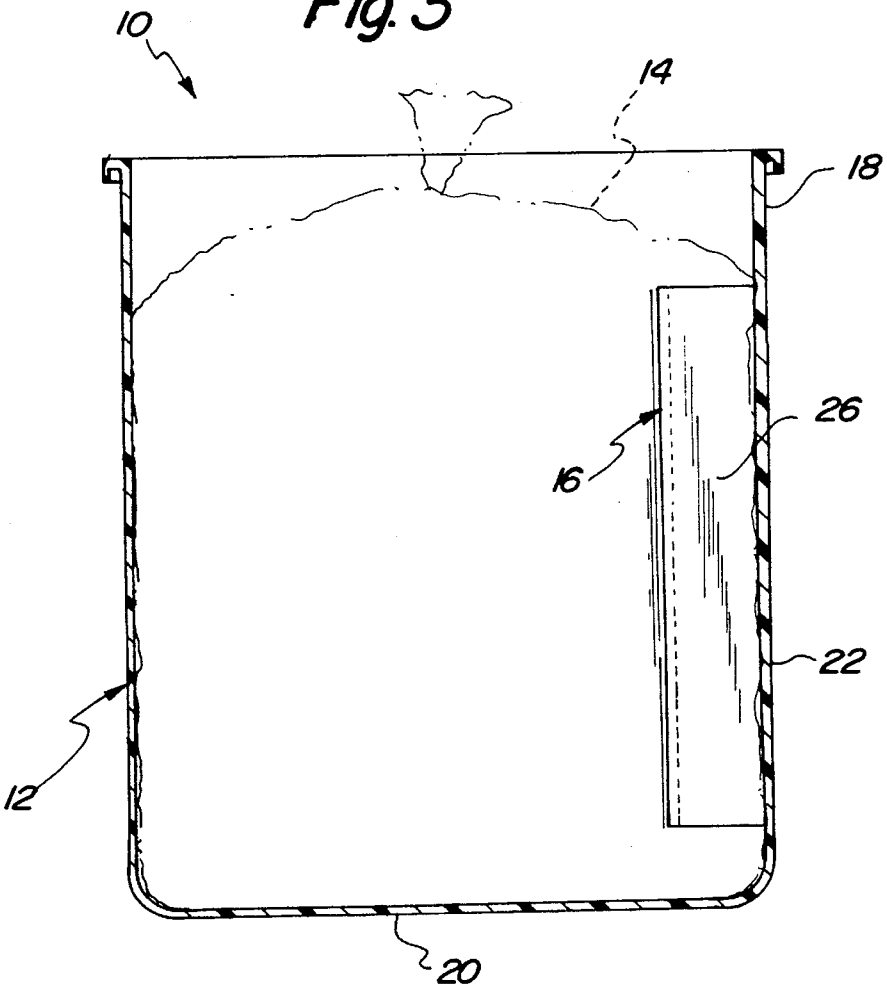
FIG. 3 is a cross-sectional view taken along line 3—3 of FIG. 2.
Figure 6:
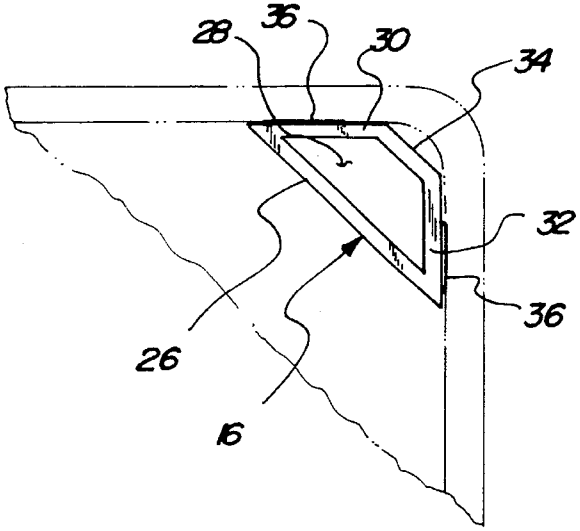
FIG. 6 is a top plan view as seen from line 6—6 of FIG. 5.
Figure 5:
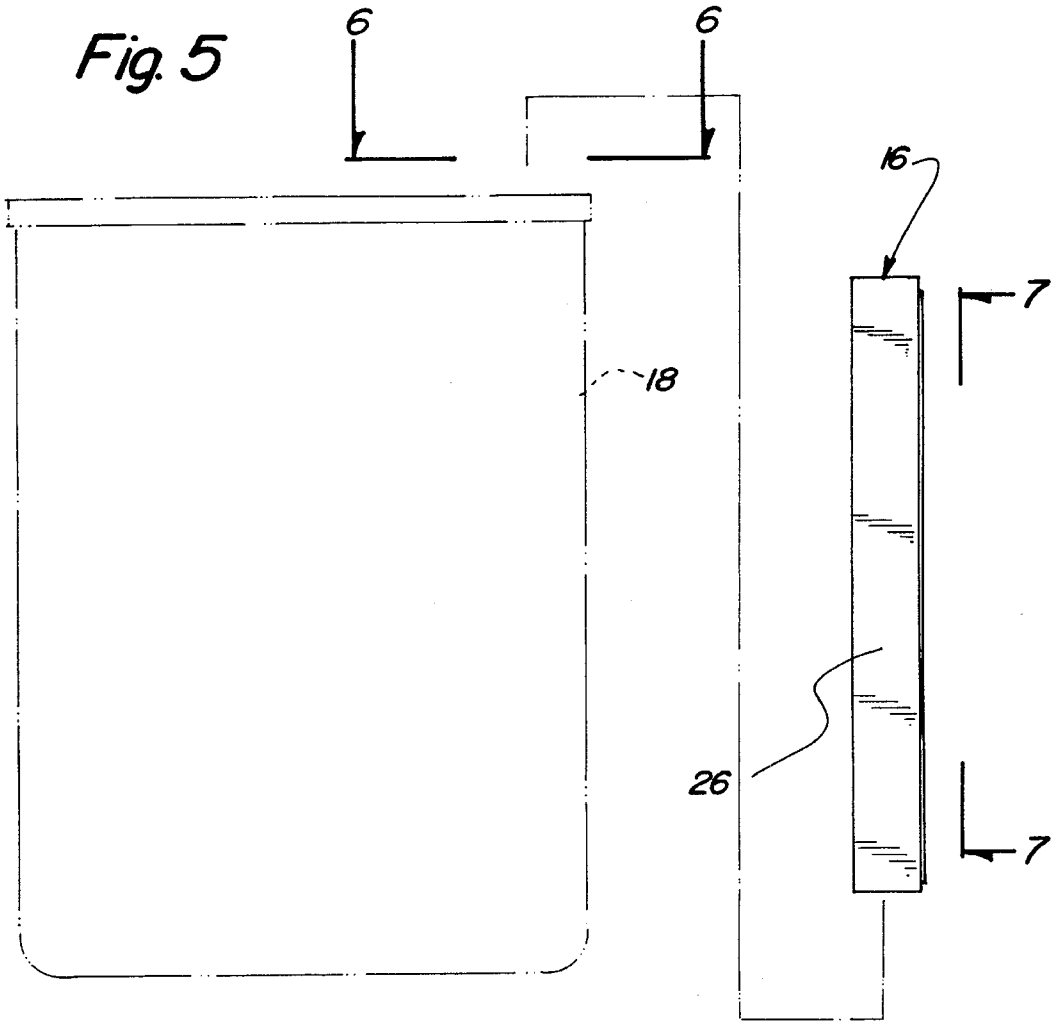
FIG. 5 is an exploded elevation view of an alternative form of the present invention for use with an existing container.

More specifically, it will be noted that the vented refuse container 10 comprises a container means 12 for receiving and supporting a trash bag 14 therewithin, as shown in FIGS. 3 and 4 of the drawings. A vent means 16 is coupled to an interior surface of the container means 12 for venting air into the container means 12 beneath the trash bag 14 to preclude a vacuum coupling of the trash bag with the container means.

Figure 2:
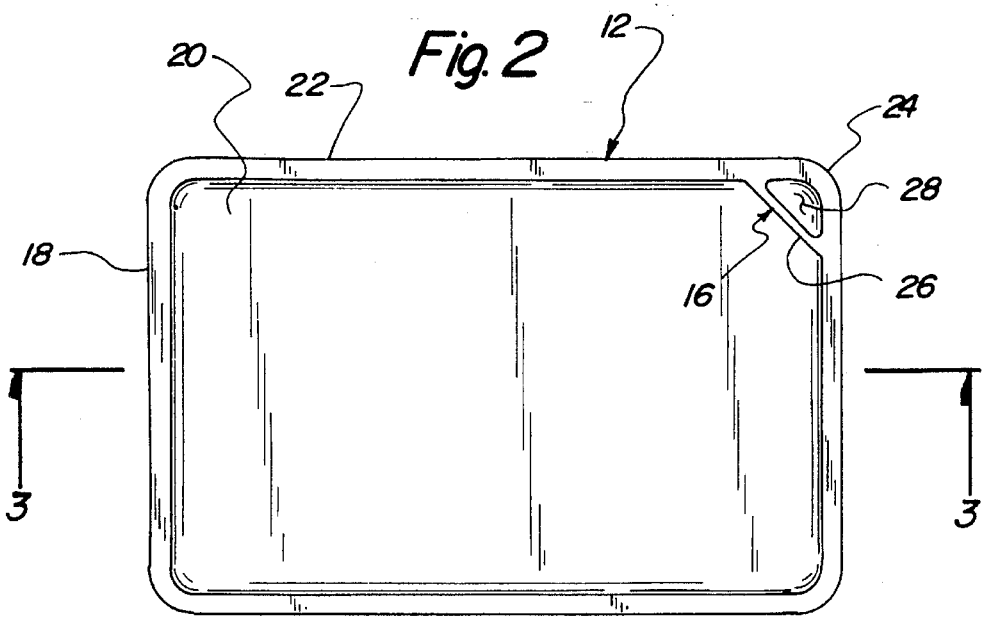
FIG. 2 is a top plan view thereof.

As best illustrated in FIGS. 2 through 4, it can be shown that the container means 12 according to the present invention 10 comprises a container 18 including a bottom wall 20 having a perimeter side wall 22 circumscribing a periphery of the bottom wall and projecting upwardly therefrom. The perimeter side wall 22 is shaped so as to define at least one corner 24 proximal to which the vent means 16 can be positioned.

With continuing reference to FIGS. 2 through 4, it can be shown that the vent means 16 according to the present invention 10 comprises a substantially rectangular panel 26 secured to adjacent interior surfaces of the perimeter side wall 22 proximal to the corner 24. The rectangular panel 26 cooperates with the corner 24 of the perimeter side wall 22 to define a venting duct 28 extending at least partially along the perimeter side wall of the container 18. By this structure and as shown in FIG. 4, air is communicated through the venting duct 28 into the container 18 proximal to the bottom wall 20 thereof to preclude or reduce a vacuum coupling between a full trash bag 14 and the container means 12.

Turning now to FIGS. 5 through 8 wherein an alternative form of the present invention 10 is illustrated, it can be shown that the same may comprise a vent means 16 for selectively coupling with a container 18 to preclude vacuum coupling between a trash bag positioned within the container and the container itself. In this alternative form of the present invention 10, the vent means 16 includes the rectangular panel 26 and further comprises a first mounting panel 30 extending along a first longitudinal edge of the rectangular panel and extending at an oblique angle relative thereto. A second mounting panel 32 is similarly coupled to a second longitudinal edge of the rectangular panel 26 and extends therefrom at an oblique angle relative thereto. The first mounting panel 30 extends towards the second mounting panel 32 at a substantially orthogonally orientation relative thereto, with a connecting panel 34 of elongated configuration extending between the first mounting panel 30 and the second mounting panel 32. The panels 26, and 30–34 cooperate to define the venting duct 28 permitting fluid communication beneath the trash bag positioned in the container 18 as described above.

Figure 7:
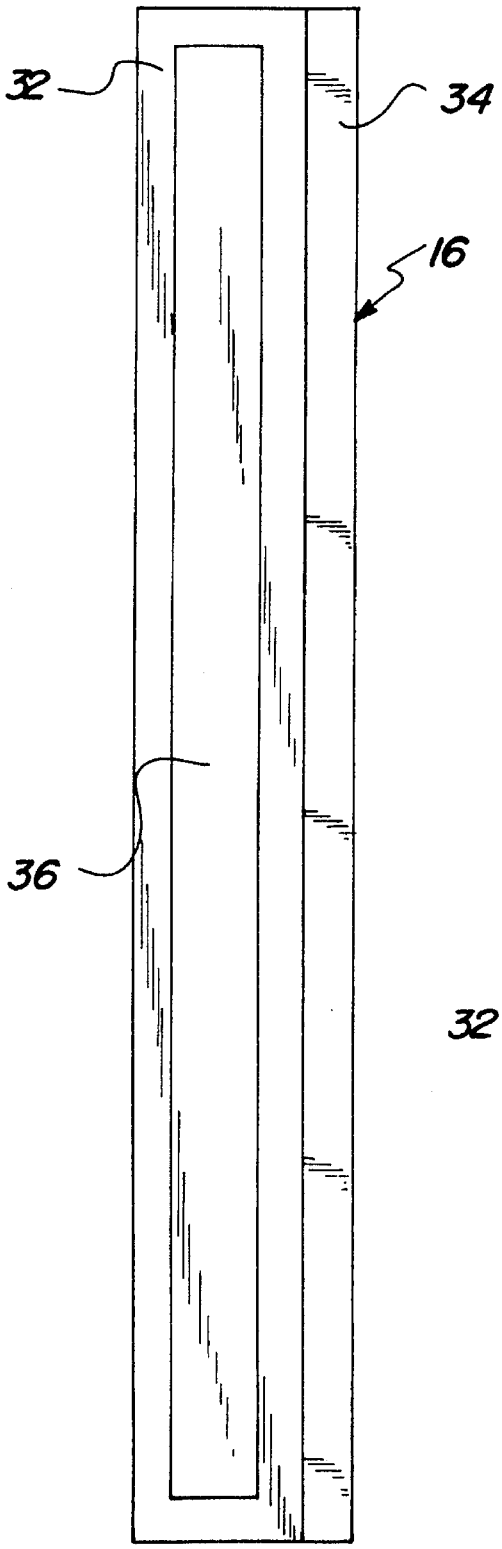
FIG. 7 is a side elevation view of the alternative form of the present invention.
Figure 8:
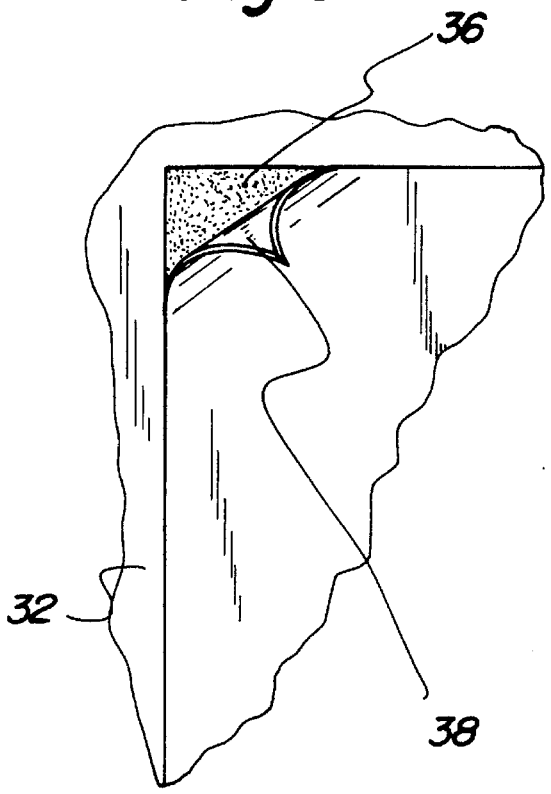
FIG. 8 is an enlarged elevation view of a portion of the alternative form of the invention.

To couple the alternative form of the vent means 16 to an interior surface of an existing container 18, at least one adhesive mounting strip 36 extends along one of the mounting panels 30 or 32. Preferably, a first adhesive mounting strip 36 extends along the first mounting panel 30, with a second adhesive mounting strip 36 extending along the second mounting panel 32, as shown in FIG. 7. By this structure, the adhesive mounting strips 36 can be selectively coupled to interior surfaces of an existing container 18 to secure the vent means 16 proximal to a corner thereof. As shown in FIG. 8, the adhesive mounting strips 36 preferably include removable backings 38 selectively covering the adhesive thereof prior to attachment of the vent means 16 to the container 18.

In use, the vented refuse container 10 of the present invention operates to preclude vacuum coupling between a full trash bag and an associated container to permit ease of removal of the loaded trash bag from the container.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A vented refuse device comprising:

a container including a bottom wall having a perimeter side wall circumscribing a periphery of the bottom wall and projecting upwardly therefrom, the perimeter side wall being shaped so as to define at least one corner, with the corner having an arcuate interior surface;

a vent means coupled to an interior surface of the container for precluding a vacuum coupling between a trash bag and the container, the vent means comprising a substantially rectangular panel having opposed first and second longitudinal edges; a first mounting panel having an inner longitudinal edge coupled to and extending along the first longitudinal edge of the rectangular panel, the first mounting panel extending from the rectangular panel at an oblique angle relative thereto, the first mounting panel being coupled to an interior surface of the side wall of the container along a first side of the corner; a second mounting panel having an inner longitudinal edge coupled to the second longitudinal edge of the rectangular panel, the second mounting panel extending from the rectangular panel at an oblique angle relative thereto, the second mounting panel being coupled to an interior surface of the side wall of the container along a second side of the corner, wherein the first mounting panel extends towards the second mounting panel at a substantially orthogonal orientation relative thereto; a connecting panel extending between outer longitudinal edges of the first mounting panel and the second mounting panel so as to extend between the first and second sides of the corner of the interior surface of the side wall, with the connecting panel being spaced from the arcuate interior surface of the corner of the side wall.

2. A vented refuse device for use with a container including a bottom wall having a perimeter side wall circumscribing a periphery of the bottom wall and projecting upwardly therefrom, the perimeter side wall being shaped so as to define at least one corner, with the corner having an arcuate interior surface, the device comprising:

a vent means couplable to an interior surface of the container for precluding a vacuum coupling between a trash bag and the container, the vent means comprising a substantially rectangular panel having opposed first and second longitudinal edges; a first mounting panel having an inner longitudinal edge coupled to and extending along the first longitudinal edge of the rectangular panel, the first mounting panel extending from the rectangular panel at an oblique angle relative thereto, the first mounting panel being couplable to an interior surface of the side wall of the container along a first side of the corner; a second mounting panel having an inner longitudinal edge coupled to the second longitudinal edge of the rectangular panel, the second mounting panel extending from the rectangular panel at an oblique angle relative thereto, the second mounting panel being couplable to an interior surface of the side wall of the container along a second side of the corner, wherein the first mounting panel extends towards the second mounting panel at a substantially orthogonal orientation relative thereto; a connecting panel extending between outer longitudinal edges of the first mounting panel and the second mounting panel so as to extend between the first and second sides of the corner of the interior surface of the side wall and the connecting panel being spaced from the arcuate interior surface of the corner of the side wall when the first and second mounting panels are coupled to the interior surfaces of the side wall of the container along the first and second sides of the corner.

* * * * *